US006164225A

United States Patent [19]

Murata et al.

[11] Patent Number: 6,164,225

[45] Date of Patent: Dec. 26, 2000

[54] ARCH CLAMP FOOT LIFTING APPARATUS

[75] Inventors: Singo Murata, Utsunomiya; Yasuhiro Nagayama, Batou-machi; Naohisa Iso, Utsunomiya, all of Japan

[73] Assignee: The Singer Company N.V., Netherlands Antilles

[21] Appl. No.: 09/104,262

[22] Filed: Jun. 24, 1998

[30] Foreign Application Priority Data

Sep. 18, 1997 [JP] Japan ..... 9-272200

[51] Int. Cl.[7] ..... D05B 29/02

[52] U.S. Cl. ..... 112/237; 112/76

[58] Field of Search ..... 112/235, 237, 112/238, 239, 240, 113, 114, 70, 76, 470.14, 77, 169

[56] References Cited

U.S. PATENT DOCUMENTS 1,820,569 8/1931 Kiewicz ..... 112/76 X 2,359,330 10/1944 Pikul ..... 112/76

4,498,407 2/1985 Landwehr et al. ..... 112/470.14 X 4,699,072 10/1987 Tsukioka ..... 112/235

5,609,115 3/1997 Ayuta et al. ..... 112/70

*Primary Examiner*—Ismael Izaguirre

*Attorney, Agent, or Firm*—Cummings & Lockwood

[57] ABSTRACT

Since a solenoid device generates the maximum drawing force at the final position of the retracting stroke of a plunger when it retracts into the solenoid device, the drawing force becomes so large at a position close to a pressing end position of a pressing member that energy is consumed than necessity, and the solenoid device is made large-sized. Accordingly, an arch clamp foot lifting apparatus of the present invention solved this problem by connecting a wedge-shaped block member to a plunger of the solenoid device and retaining an upper portion of the pressing member on a cam surface of a block member through a driven portion.

4 Claims, 6 Drawing Sheets

ARCH CLAMP FOOT LIFTING APPARATUS

BACKGROUND OF THE INVENTION

1. Field of the Invention

The present invention relates to an arch clamp foot lifting apparatus of a bar tacking machine.

2. Prior Art

FIG. 6 is a schematic view of a conventional bar tacking machine, which comprises an arch clamp device 22 which is disposed on an upper surface of a sewing machine bed 6, an arch clamp foot driving device 30 which is disposed in the sewing machine bed 6 for driving the arch clamp device 22 in the direction of X and Y axes, and an arch clamp foot lifting apparatus 33 which is disposed on the sewing machine arm 31 for driving the arch clamp foot 7 to move the arch clamp foot 7 up and down In the conventional bar tacking machine, when a solenoid of a solenoid device 14 is excited to retract a plunger 14*a* into the solenoid device 14, a connecting link 50 is drawn rightward in FIG. 6 against resiliency of a return spring 51 so that upper and lower links 46 and 47 forming a shape of angle are extended up and down in the longitudinal direction thereof. As a result, a protrusion portion 40*a* of a retaining member 40, in its turn, a base end part of the retaining member 40 is pressed downward by a flange portion 5*a* of a presser member 5 to position lower than a pin 37 of an arch clamp foot lifting lever 38 so that the arch clamp foot lifting lever 38 is swung clockwise about the pin 37 against resiliency of an arch clamp foot spring 39, and hence the arch clamp foot 7 moves upward. When the arch clamp foot 7 moves upward, a material to be sewn between the arch clamp foot 7 and a throat plate 36 of a feed plate 23 is released from the clamping therebetween. There are provided a pin 48 which swingably connects the upper and lower links 46 and 47, a pin 70 which swingably supports the upper end of the upper link 46 on the sewing machine arm 31 and a pin 71 which swingably supports the lower end of the lower link 47 on the pressing member 5.

When the solenoid of the solenoid device 14 is released to the non-excitation position, the connecting link 50 and the plunger 14*a* are drawn leftward in FIG. 6 owing to resiliency of the return spring 51, and the upper and lower links 46 and 47 are bent in a shape of angle to reduce the length thereof in the up-and-down direction. Accordingly, the pressing member 5 is pulled upward and the flange portion 5*a* is brought into contact with a guide bush 43 attached to the sewing machine arm 31, thereby releasing the pressing state of the protrusion portion 40*a* by the flange portion 5*a*. As a result, the arch clamp foot lifting lever 38 which receives resiliency of the arch clamp foot spring 39 swings counter-clockwise about the pin 37 to lower the arch clamp foot 7 so that the material to be sewn can be clamped between the arch clamp foot 7 and the throat plate 36.

When the arch clamp device 22 is moved on the upper surface of the sewing machine bed 6 in the direction of X and Y axes in a state where the material to be sewn is clamped between the arch clamp foot 7 and the throat plate 36 so that the material to be sewn is subjected to a given bar tacking stitches by a needle 49.

However, such a conventional arch clamp foot lifting apparatus has a construction that the pressing member 5 which is supported on the sewing machine arm 31 to move up and down is operated by the solenoid device 14 through the angle-shaped upper and lower links 46 and 47, so that the following problems occur.

FIG. 7 is a view for explaining the mutual motion between the angle-shaped upper and lower links 46 and 47, the plunger 14*a* of the solenoid device 14 and the pressing member 5. In the same figure, when a point a (a pin 48 to which a drawing force N is applied) of the angle-shaped upper and lower links 46 and 47 is drawn by the solenoid device 14 with the drawing force N, a pushing-down force W against resiliency P by the arch clamp foot spring 39 from the lower portion is generated on the pressing member 5 connected to a point b (pin 71). The drawing force N for generating the pushing-down force W for pushing down the point b against the resiliency P by the arch clamp foot spring 39 is sufficiently and abruptly small when the opening angle θ of the angle-shaped upper and lower links 46 and 47 approaches to zero. This is evident in view of the mechanism of the link. A linear line A shown in FIG. 7 shows a moving locus of the point a, and the point a which is drawn by the solenoid device 14 moves from $A_5$ to $A_1$. $A_0$ is a crossing point between a line connecting the points b and c and the moving locus A. Accordingly, $A_5$ corresponds to a pressing start position of the pressing member 5 and $A_1$ corresponds to a pressing end position thereof.

As evident from FIG. 7, the pushing-down force W generated considering the increase of the resiliency P of the arch clamp foot spring 39 which is compressed when the pressing member 5 lowers and the drawing force N of the solenoid device 14 needed for generating the pushing-down force W have the following expressions.

$N_5=W_5\times\tan\theta_5$ at the pressing start position $A_5$.

$N_1=W_1\times\tan\theta_1$ at the position close to the pressing end position $A_1$.

Where $W_5$ is a pressing force needed at the start of the pressing of the pressing member 5.

$W_1$ is a pressing force needed at the end of the pressing of the pressing member 5.

Suppose that $W_5:W_1=1:2$ and $\theta_5=25°$ and $\theta_1=5°$, the following expressions are established.

$N_5=0.466$, and $N_1=0.157$

Suppose that the pushing-down force W has an equation expressed by $W_5:W_1=1:2$ considering the increase of the resiliency P of the arch clamp foot spring 39 which is compressed as the pressing member 5 lowers.

It is understood from the above that the maximum drawing force $N_5$ (0.466) is needed at the pressing start position $A_5$ of the pressing member 5, and the drawing force $N_1$ (0.157), which is about one thirds of the maximum drawing force $N_5$, is needed at the pressing end position $A_1$.

In FIG. 8, a line $T_1$ shows the drawing force N of the solenoid device 14 needed for pressing down the pressing member 5 from the pressing start position A5 to the pressing end position $A_1$.

On the other hand, the actual drawing force N of the solenoid device 14 has the characteristics of a curve $S_1$, and it increases when the plunger 14*a* retracts into the solenoid device 14. That is, the maximum drawing force $N_1$ is generated at the final position ($A_1$) of the retracting stroke of the plunger 14*a*. This runs counter to the drawing forces $N_5$ and $N_1$ of the solenoid device 14 needed based on the result of calculation wherein the excessive drawing force $N_1$ is generated at the position close to the pressing end position $A_1$ to satisfy the drawing force $N_5$ at the position close to the pressing start position $A_5$. As a result, energy is wasted.

SUMMARY OF THE INVENTION

It is an object of the present invention to provide an arch clamp foot lifting apparatus capable of reducing the drawing force N of the solenoid device 14 compared with that of the conventional solenoid device 14 and of preventing wasting of energy, thereby making the solenoid device 14 small sized and achieving economical effect related thereto.

To achieve the above object, the arch clamp foot lifting apparatus according to a first aspect of the invention comprises a solenoid device (14) which is horizontally disposed in a sewing machine arm (31) and has a plunger **(14*a*), a pressing member (5, 15) provided on the sewing machine arm (31) to be movable up and down, an arch clamp foot (7) and a throat plate (36), wherein the plunger (14*a*) protrudes from the solenoid device (14) when the solenoid device (14) is not energized, and the pressing member (5, 15) moves upward when the plunger 14*a* protrudes from the solenoid device (14), and the arch clamp foot (7) lowers while interlocking with the upward movement of the pressing member (5, 15) to clamp a material to be sewn on the upper surface of the throat plate (36), wherein the plunger (14*a*) retracts into the solenoid device (14) when the solenoid device (14) is energized, and the pressing member (5, 15) moves downward when the plunger (14*a*) retracts into the solenoid device (14), and the arch clamp foot (7) moves upward while interlocking with the downward movement of the pressing member (5, 15) to release a material to be sewn from the upper surface of the throat plate (36), characterized in that a wedge-shaped block member (16) is connected to the plunger (14*a*) of the solenoid device (14) and an upper portion of the pressing member (5, 15) retains on a cam surface (16*a*) of the block member (16) through a driven portion (19, 15*b*, 20)**.

The arch clamp foot lifting apparatus according to a second aspect of the invention in characterized in that the driven portion **(19, 15*b*, 20) of the first aspect of the invention includes a roller (20) rotatably provided thereon, and that the roller (20) ratably retains on the cam surface 16*a* of the block member (16)**.

The arch clamp foot lifting apparatus according to a third aspect of the invention is characterized in that the driven portion (19, 20) comprises a driven link (19) which is supported on the pressing member (5, 15) by a pin (27) and the roller (20) which is rotatably provided on the driven link (19), and that the roller (20) rotatably retains on the cam surface **(16*a*) of the block member (16) and the driven link (19) is supported on the sewing machine arm (31)** to move up and down.

The arch clamp foot lifting apparatus according to a fourth aspect of the invention is characterized in that the driven portion **(15*b*, 20) includes the roller (20) which is rotatably supported on an upper end portion of the pressing member (15), and that the roller (20) rotatably retains on the cam surface (16*a*) of the block member (16)**.

PREFERRED EMBODIMENT OF THE INVENTION

An arch clamp foot lifting apparatus according to a first embodiment of the invention will be now described with reference to FIGS. 1 to 4.

Figure 1:
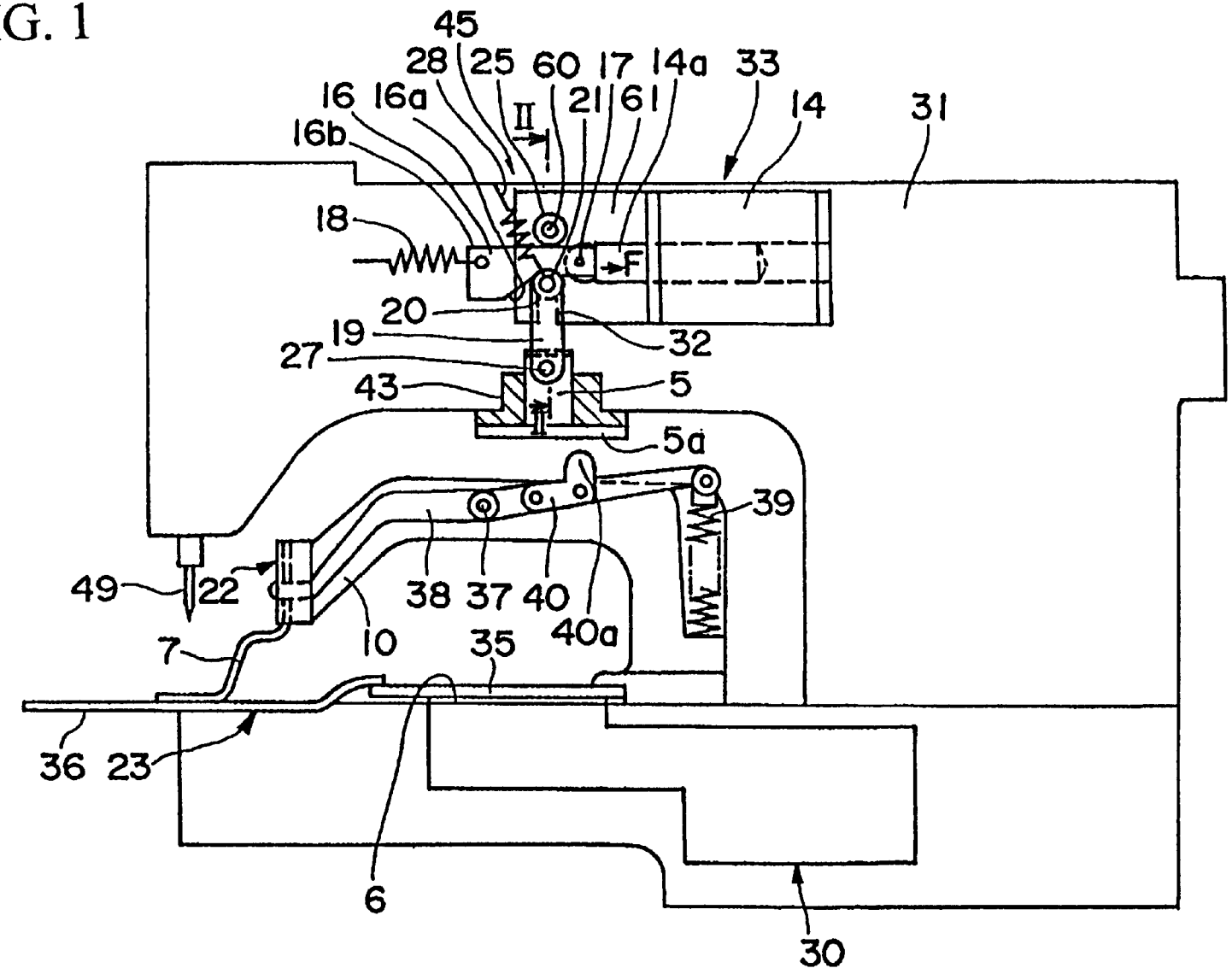
FIG. 1 is a schematic view of a bar tacking machine provided with an arch clamp foot lifting apparatus according to a preferred embodiment of the invention.

FIG. 1 shows a schematic view of a bar tacking machine comprising an arch clamp device 22 which is disposed on an upper surface of a sewing machine bed 6, an arch clamp foot driving device 30 which is disposed in the sewing machine bed 6 for driving the arch clamp device 22 in the direction of X and Y axes, and an arch clamp foot lifting apparatus 33 which is disposed in the sewing machine arm 31 for driving an arch clamp foot 7 to move the arch clamp foot 7 up and down.

The arch clamp device 22 comprises an arch-shaped arch clamp frame 10, the arch clamp foot 7 which is supported by the tip end portion of the arch clamp frame 10 to move up and down, a feed plate carrier member 35 which is fixedly secured to the base end portion of the arch clamp frame 10 and extends along the upper surface of the sewing machine bed 6, and a throat plate 36 which is fixedly secured to the tip end portion of the feed plate carrier member 35 for clamping a material to be sewn between itself and the arch clamp foot 7, wherein a needle location groove (not shown) through which a needle 49 passes is defined in the throat plate 36 by penetrating it. A feed plate 23 is constituted by the feed plate carrier member 35 and the throat plate 36.

An arch clamp foot lifting lever 38 which is swingably supported by a pin 37 at the intermediate portion thereof is provided on the arch clamp frame 10, wherein the tip end portion of the arch clamp foot lifting lever 38 is fixed to the arch clamp foot 7 and an arch clamp foot spring 39 is interposed between the base end portion of the arch clamp foot lifting lever 38 and the base end portion of the arch clamp frame 10 while it is compressed so that the arch clamp foot 7 is biased to bring into contact with the throat plate 36. A retaining member 40 is fixed to the base end portion of the arch clamp foot lifting lever 38 and a protrusion portion **40*a* of the retaining member 40 opposes the lower surface of a pressing member 5 of the arch clamp foot lifting apparatus 33**, described later.

The arch clamp foot lifting apparatus 33 includes a solenoid device 14 which is fixedly secured to the sewing machine arm 31 in a horizontal state, the pressing member 5 which is guided by a guide bush 43 fixedly secured to the sewing machine arm 31 to move up and down, and an elevating mechanism 45 for driving the pressing member 5 by the operation of the solenoid device 14 to move the pressing member 5 up and down. The solenoid device 14 is a type for retracting the plunger **14*a* into the solenoid device 14 when a solenoid of the solenoid device 14 is energized. The elevating mechanism 45 includes a block member 16 which is provided on the sewing machine arm 31 and constituting a wedged-shaped linear moving cam and is movable only to the right and left, and a driven link 19** having the upper end which contacts a cam surface 16*a* formed on the lower surface of the block member 16 and a lower end portion which is connected to the pressing member 5.

The block member 16 is swingably connected to the plunger 14*a* of the solenoid device 14 by a hinge pin 17 at the right end portion in FIG. 1, and it is always drawn leftward by resiliency of a tension spring 28 which stretches between the hinge pin 17 and the sewing machine arm 31, thereby biasing the plunger 14*a* in the protruding direction thereof. Further, the block member 16 has a flat upper surface 16*b* which is brought into contact with and supported by a guide roller 25 and which is rotatably supported by a bracket 61 fixedly secured to the sewing machine arm 31 by a pin 60. A driven link 19 has the lower end portion which is fixed to the upper end of the pressing member 5 by the pin 27, and the upper end portion on which a roller 20 is rotatably supported by a shaft 21. Further, the driven link 19 is always biased upward by resiliency of the tension spring 28 which stretches between itself and the sewing machine arm 31. Accordingly, the roller 20 rotatably retains on the cam surface 16*a* of the block member 16. The roller 20 of the a driven link 19 which is drawn upward by the tension spring 28 is pressed against the cam surface 16*a* of the block member 16 and the upper surface 16*b* of the block member 16 is brought into contact with and supported by a guide roller 25 so that the block member 16 is provided on the sewing machine arm 31 to be movable only to the right and left.

Figure 2:
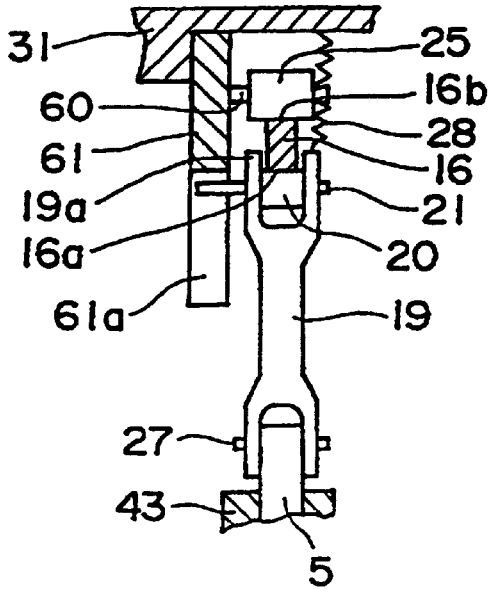
FIG. 2 is a sectional view taken along the line II—II of FIG. 1.

One end protruding from the roller 20 of the shaft 21 retains on and is guided by a groove portion 61*a* of a bracket 61 as shown in FIG. 2 so that the driven link 19 and the roller 20 can move up and down. Accordingly, the pressing member 5 is guided by a guide bush 43 when the pressing member 5 and the driven link 19 move up and down so that the driven link 19 is guided by the groove portion 61*a*.

A Y-shaped forked portion 19*a* provided on the upper end portion of the driven link 19 holds the block member 16 at the front and rear surfaces thereof to maintain the retaining state between the cam surface 16*a* and the roller 20 as shown in FIG. 2. The cam surface 16*a* of the block member 16 is formed by an inclination plain surface which gradually inclines to the left in FIG. 1, and the cam surface 16*a* retracts into the solenoid device 14 when the solenoid device 14 is energized so that the block member 16 operates in the direction of an arrow F. As a result, the roller 20, the driven link 19 and the pressing member 5 gradually lower. The roller 20 and the driven link 19 are provided on the upper portion of the block member 16 to form the driven portion for retaining the block member 16.

Meanwhile, in a non-energizing state where the solenoid of the solenoid device 14 released from the excitation, the plunger 14*a* protrudes from the solenoid device 14 by the resiliency of the return spring 18 through the block member 16. At this time, since the roller 20 retains on the minimum protruding position (upper end portion) of the cam surface 16*a* of the block member 16, the driven link 19 is drawn upward by the tension spring 28 so that the pressing member 5 is pulled upward and the flange portion 5*a* is substantially brought into contact with the lower surface of the guide bush 43, thereby releasing a pressing state of the protrusion portion 40*a* of the retaining member 40 by the flange portion 5*a*. As a result, the arch clamp foot lifting lever 38 for receiving the resiliency of the arch clamp foot spring 39 swings counterclockwise about the pin 37 to lower the arch clamp foot 7 so that the material to be sewn is clamped between the arch clamp foot 7 and the throat plate 36. In this state, a given gap is defined between the lower surface of the flange portion 5*a* and the protrusion portion 40*a* of the retaining member 40 as shown in FIG. 1.

The material to be sewn is subjected to a given bar tacking stitches by the needle 49 while the arch clamp device 22 is moved on the upper surface of the sewing machine bed 6 by the arch clamp foot driving device 30 in the direction of the X and Y axes in a state where the material to be sewn is clamped between the arch clamp foot 7 and throat plate 36.

On the other hand, if the plunger 14*a* retracts into the solenoid device 14 when the solenoid of the solenoid device 14 is energized, the block member 16 is drawn rightward in FIG. 1 (in the direction of the arrow F) against the resiliency of the return spring 18 so that the roller 20, the driven link 19 and the pressing member 5 are pressed downward along the shape of the cam surface 16*a*. When the pressing member 5 lowers, the protrusion portion 40*a* of the retaining member 40, in its turn, the base end portion of the arch clamp foot lifting lever 38 is pressed downward by the flange portion 5*a* against the resiliency of the arch clamp foot spring 39 thereof, so that the arch clamp foot lifting lever 38 swings clockwise about the pin 37 to raise the arch clamp foot 7. As a result, the clamping of the material to be sewn between the arch clamp foot 7 and the throat plate 36 is released. In a state where the block member 16 and the plunger 14*a* sufficiently retracts, the roller 20 retains at the maximum protruding position (lower end portion) of the cam surface 16*a* of the block member 16. The drawing force of the solenoid device 14 is set in the manner that it is slightly greater than a force of the block member 16 which is pressed to the left in FIG. 1 owing to the resiliency of the arch clamp foot spring 39 applied to the roller 20 of the driven link 19 from the lower portion thereof and the resiliency of the return spring 18, etc. with the force close to the maximum drawing force when the plunger 14*a* deeply retracts into the solenoid device 14 when the solenoid of the solenoid device 14 is energized.

The function of the arch clamp foot lifting apparatus will be now described hereinafter.

If the solenoid device 14 of the arch clamp foot lifting apparatus having such a construction is energized by a control unit, not shown, the plunger 14*a* retracts into against the resiliency of the return spring 18 so that the block member 16 connected to the plunger 14*a* moves in the same direction as the plunger 14*a* while the upper surface 16*b* of the block member 16 is supported by the rotating guide roller 25. As a result, the roller 20 of the driven link 19 rotates along the cam surface 16*a* and lowers along the cam surface 16*a*.

When the roller 20 lowers along the cam surface 16*a*, the driven link 19 is pressed downward against the resiliency of the tension spring 28. The lowering motion of the driven link 19 is performed vertically because the shaft 21 retains on the vertical groove portion 61*a* provided on the bracket 61 and the lower end thereof is fixed to the upper end portion of the pressing member 5 by the pin 27, and further, the pressing member 5 is guided by the guide bush 43 fixedly secured to the sewing machine arm 31, and hence.

As a result, the flat lower surface of the flange portion 5*a* of the pressing member 5 connected to the driven link 19 contacts the protrusion portion 40*a* integrated with the arch clamp foot lifting lever 38, successively the arch clamp foot lifting lever 38 is pressed against the resiliency of the arch clamp foot spring 39 of the arch clamp frame 10 so that the arch clamp foot 7 which is clamped against the sewing machine bed 6 is pulled upward to release the material to be sewn. Accordingly, the solenoid device 14 is energized by a control unit, not shown, when completing the sewing operation which is carried by the up-and-down movement of the needle 49, so that the arch clamp foot 7 moves upward to release the material to be sewn from the throat plate 36.

Meanwhile, when the solenoid of the solenoid device 14 is not energized, the plunger 14*a* protrude from the solenoid device 14 owing to the resiliency of the return spring 18 by way of the block member 16 and the driven link 19 is pulled upward by the tension spring 28 so that the pressing member 5 is pulled upward to bring the flange portion 5*a* into contact with the lower surface of the guide bush 43, thereby releasing the pressing state of the protrusion portion 40*a* of the retaining member 40 by the flange portion 5*a*. At this time, the block member 16 moves in the same direction (in the direction of the arrow F in the same figure) as the plunger 14*a* while the upper surface 16*b* is supported by the rotating guide roller 25. The roller 20 of the driven link 19 moves upward along the cam surface 16*a* while it rotates on the cam surface 16*a*.

Involved in this operation, the arch clamp foot lifting lever 38 for receiving the resiliency of the arch clamp foot spring 39 swings counterclockwise to lower the arch clamp foot 7, so that the material to be sewn can be clamped between the arch clamp foot 7 and the throat plate 36. Accordingly, when the sewing operation starts with the up-and-down movement of the needle 49, the solenoid device 14 is energized by the control unit, not shown, to move the arch clamp foot 7 upward, so that the material to be sewn is disposed on the upper surface of the throat plate 36, thereafter the solenoid device 14 is made non-energized to lower the arch clamp foot 7 so as to clamp the material to be sewn against the upper surface of the throat plate 36.

Figure 3:
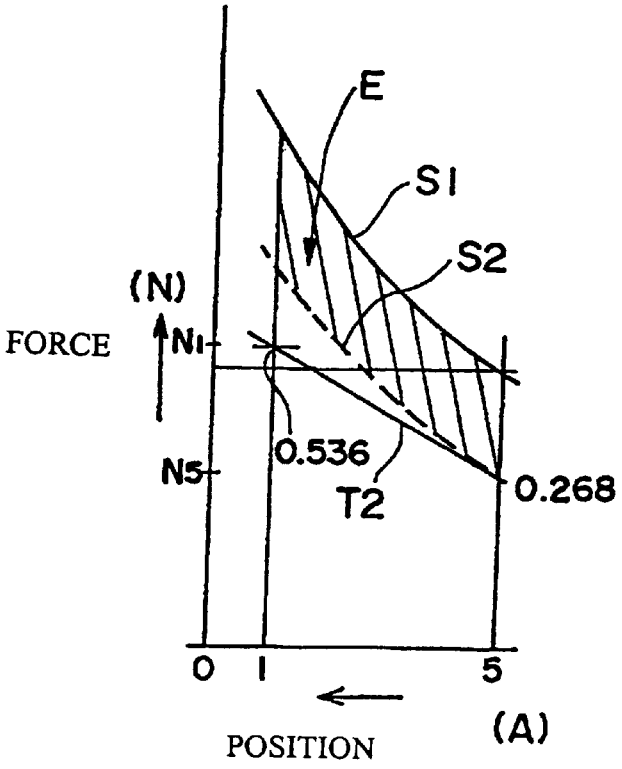
FIG. 3 is a graph showing the relation between a moving locus of a block member and drawing force characteristics of a solenoid device.
Figure 4:
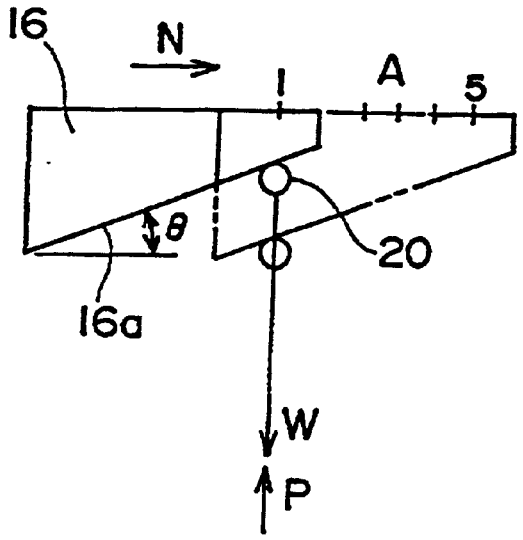
FIG. 4 is a view for explaining the operation of the arch clamp foot lifting apparatus.

Described hereinafter with reference to FIGS. 3 and 4 is the drawing force N of the solenoid device 14 which is needed for pressing the pressing member 5 downward relative to the block member 16 at each position of $A_5$ to $A_1$ of the moving locus of the block member 16 shown by the linear line A. FIG. 3 shows the relation between the moving locus A of the block member 16 and the drawing force N of the solenoid device 14. FIG. 4 shows the lowering operation of the roller 20, the driven link 19 and the pressing member 5 relative to the block member 16 at each position of $A_5$ to $A_1$ of the moving locus of the block member 16 shown by the linear line A.

In FIG. 4, suppose that the inclination angle of the cam surface 16*a* of the block member 16 is θ, the following expressions are established.

$N_5=W_5\times\tan\theta$ at the pressing start position $A_5$.

$N_1=W_1\times\tan\theta$ at the position close to the pressing end position $A_1$.

Where $W_5$ is a pressing force needed for starting the pressing of the pressing member 5.

$W_1$ is a pressing force needed for ending the pressing of the pressing member 5.

Suppose that $W_5:W_1=1:2$ and $\theta=15°$ (constant), the following expressions are established.

$N_5=0.268$, and $N_1=0.536$

Accordingly, it is understood that the minimum drawing force $N_5$ is needed at the pressing start position $A_5$ of the pressing member 5 and the drawing force N, at the pressing end position $A_1$ of the pressing member 5 is needed twice as large as that of the drawing force $N_5$ at the pressing start position $A_5$. That is, when the block member 16 is used, the drawing force $N_1$ of the solenoid device 14 which is needed at the pressing end position $A_1$ can be increased compared with the drawing force $N_5$ needed at the pressing start position $A_5$ considering the increase of the resiliency P of the arch clamp foot spring 39 which is compressed as the pressing member 5 lowers. A line T2 in FIG. 3 indicates the drawing force N which is needed to press the solenoid device 14 downward from the pressing start position $A_5$ to the pressing end position $A_1$ of the pressing member 5. Accordingly, it is understood that when the appropriate angle is selected as and given to the inclination of the cam surface 16*a* of the wedge-shaped block member 16, the change of the pushing-down force W which is needed for pressing the arch clamp foot lifting lever 38 by the pressing member 5 can be substantially conformed to the characteristic curve of the drawing force N of the solenoid device 14. Meanwhile, the drawing force N of the solenoid device 14 has the characteristic in that the drawing force N increases as the plunger 14*a* retracts into the solenoid device 14.

That is, when the block member 16 is used as the arch clamp foot lifting apparatus, the solenoid device 14 having a characteristic S2 which is weak in drawing force can be used instead of the solenoid device 14 having a characteristic S1 which is used with the conventional angle-shaped upper and lower links 46 and 47. As a result, it is possible to save the energy to be consumed by the solenoid device 14 as shown by the hatched lined range E in FIG. 3.

Although the cam surface 16*a* of the block member 16 is formed by the inclined surface according to the preferred embodiment of the invention, the shape of the cam surface 16*a* of the block member 16 extending from the substantially minimum protrusion position corresponding to the pressing start position $A_5$ to the substantially maximum protrusion position corresponding to the pressing end position $A_1$ can be arbitrarily set to the characteristic S2 of the drawing force N of the solenoid device 14. For example, the cam surface 16*a* can be formed of a combination of inclined surfaces which are connected arbitrarily or curve or the like.

Figure 5:
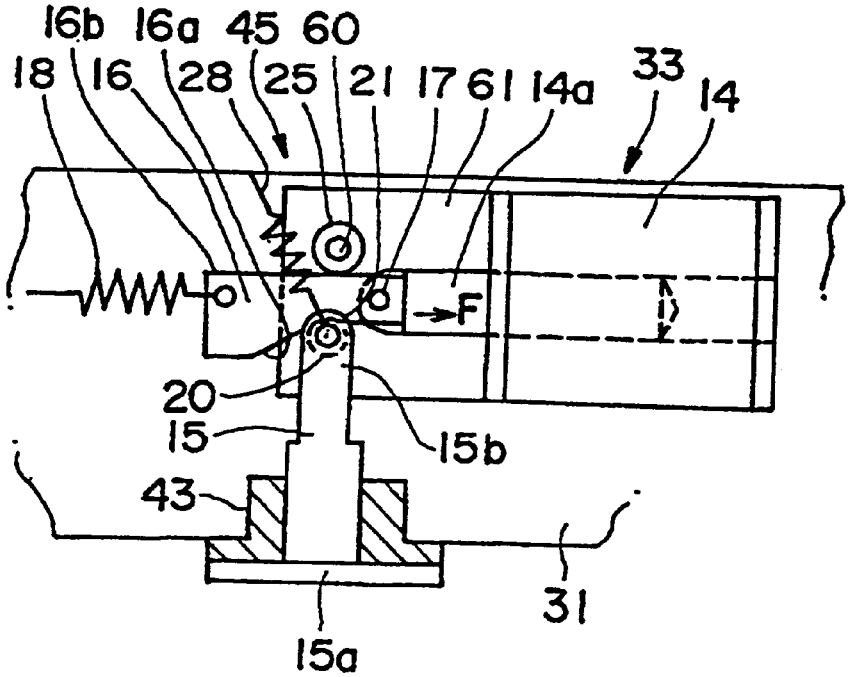
FIG. 5 is a schematic view showing another construction of a pressing member.
Figure 6:
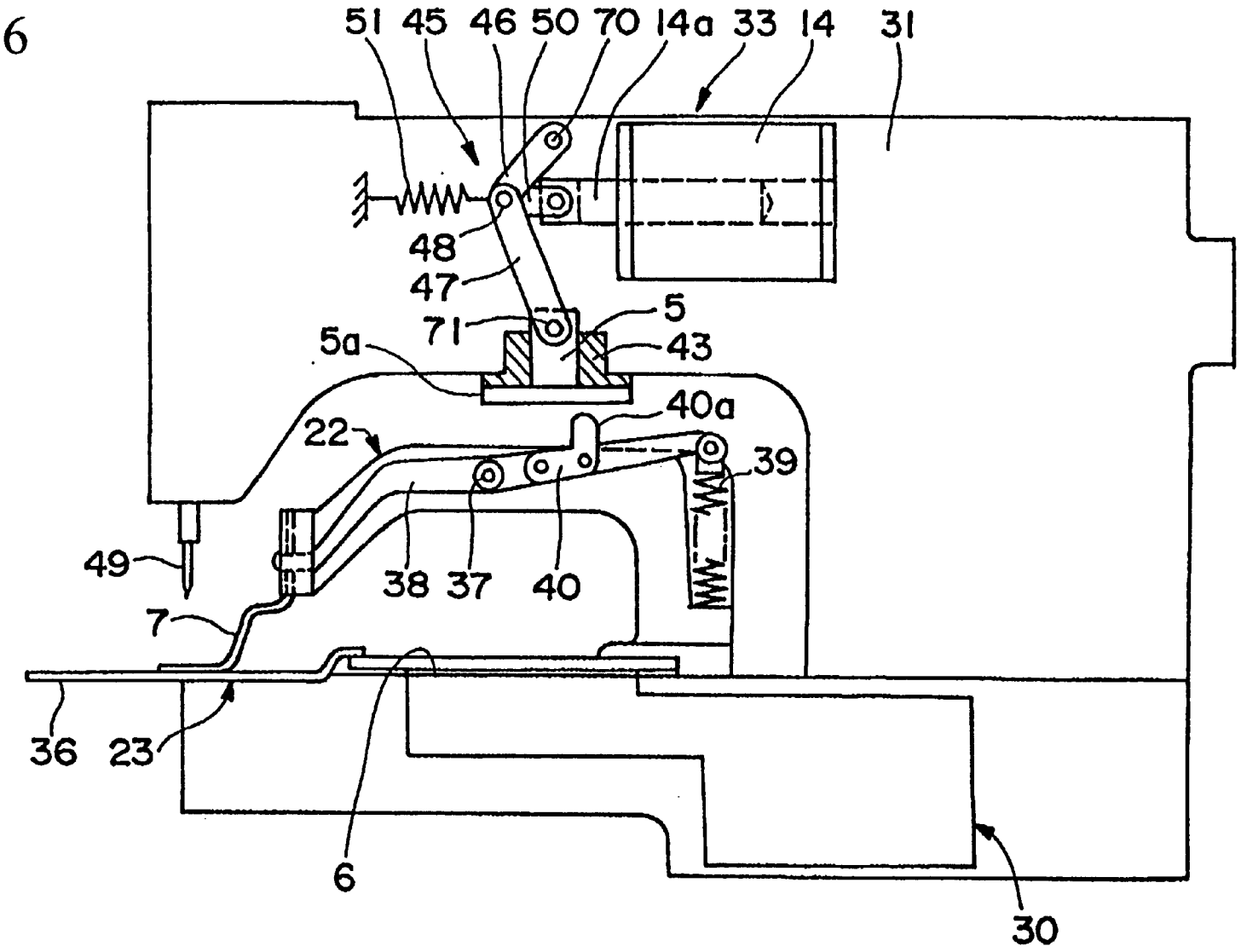
FIG. 6 is a schematic view of a bar tacking machine provided with a conventional arch clamp foot lifting apparatus.
Figure 7:
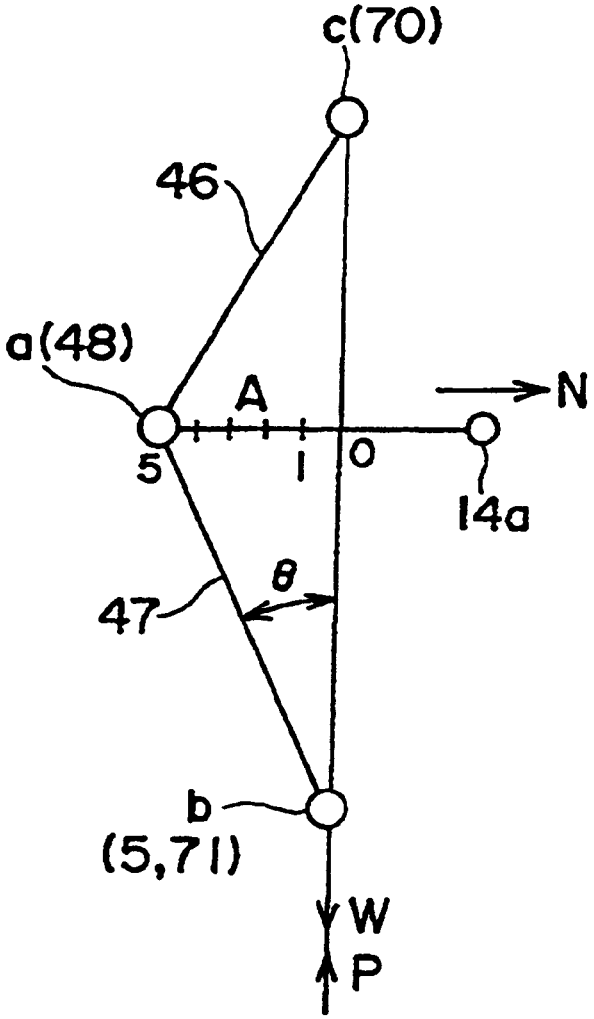
FIG. 7 is a view for explaining the operation of the conventional arch clamp foot lifting apparatus.
Figure 8:
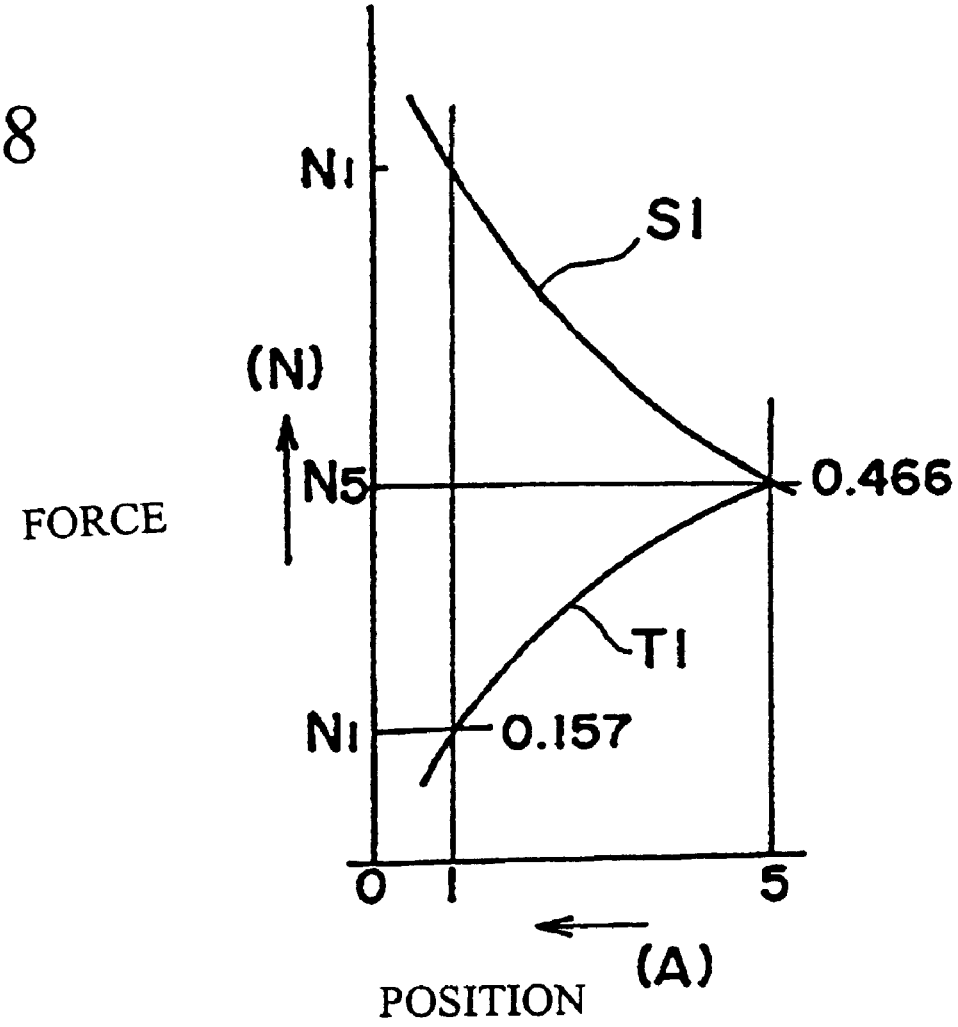
FIG. 8 is a graph showing the relation between a moving locus of a point a to which the drawing force of the solenoid device is applied and the drawing force of the solenoid device characteristics in the conventional arch clamp foot lifting apparatus.

FIG. 5 shows another example of construction of the pressing member 15. The pressing member 15 has a construction in which the pressing member 5 having the flange portion 5*a* and the driven link 19 as set forth in the preferred embodiment are integrated with each other and they are guided rotatably by the guide bush 43 fixedly secured to the sewing machine arm 31 to move up and down. The roller 20 which is rotatably supported by the shaft 21 on the driven portion 15*b* of the pressing member 15 rotatably contacts the cam surface 16*a* of the block member 16. The roller 20 and the upper end portion 15*b* of the pressing member 15 are provided on the upper portion of the pressing member 15 and has a driven portion which retains on the block member 16.

With the construction set forth above, since the up-and-down operation of the pressing member 15 is guided by the guide bush 43, it is not necessary to retain the shaft 21 on the groove portion 61*a* of the bracket 61 to be guided thereby as shown in the first embodiment, thereby dispensing with the groove portion 61*a*. The protrusion portion 40*a* of the arch clamp foot lifting lever 38 is pressed by the flange portion 15*a* of the pressing member 15.

Meanwhile, the elevating mechanism 45 of the first embodiment is movable only to the right and left and is provided on the sewing machine arm 31, and comprises the block member 16 forming the wedge-shaped linearly movable cam, the pressing member 5 or 15, which retains on the cam surface 16*a* of the block member 16 through the roller 20 and the tension spring 28, etc. However, if the block member 16 is replaced with a positive motion cam, and the roller 20 is surely movable along the shape of the cam of the block member 16, the tension spring 28 can be dispensed with.

As will be understood from the above explanation, the following effects can be obtained by the arch clamp foot lifting apparatus of the present invention.

The change of pressing force which is needed for operating the arch clamp foot by the presser member can be substantially conformed to the characteristic curve of the drawing force of the solenoid device by forming the cam surface of the block member in an appropriate shape. Accordingly, it is possible to use the small sized solenoid device which has a small drawing force compared with the conventional solenoid device. As a result, it is possible to save the energy to be consumed, and reduce the accommodation space of the solenoid device, thereby reducing the total height of the sewing machine.

What is claimed is:

1. An arch clamp foot lifting apparatus comprising a solenoid device which is horizontally disposed in a sewing machine arm and has a plunger, a pressing member provided on the sewing machine arm to be movable up and down, an arch clamp foot and a throat plate, wherein the plunger protrudes from the solenoid device when the solenoid device is not energized, and the pressing member moves upward when the plunger protrudes from the solenoid device, and the arch clamp foot lowers while interlocking with the upward movement of the pressing member to clamp a material to be sewn on the upper surface of the throat plate, wherein the plunger retracts into the solenoid device when the solenoid device is energized, and the pressing member moves downward when the plunger retracts into the solenoid device, and the arch clamp foot moves upward while interlocking with the downward movement of the pressing member to release a material to be sewn from the upper surface of the throat plate, characterized in that:

a wedge-shaped block member is connected to the plunger of the solenoid device and an upper portion of the pressing member retains on a cam surface of the block member through a driven portion.

2. The arch clamp foot lifting apparatus according to claim 1, wherein the driven portion includes a roller rotatably provided thereon, and wherein the roller rotatably retains on the cam surface of the block member.

3. The arch clamp foot lifting apparatus according to claim 1, wherein the driven portion comprises a driven link which is supported on the pressing member by a pin and the roller which is rotatably provided on the driven link, and wherein the roller rotatably retains on the cam surface (16*a*) of the block member and the driven link is supported on the sewing machine arm to move up and down.

4. The arch clamp foot lifting apparatus according to claim 1, wherein the driven portion includes the roller which is rotatably supported on an upper end portion of the pressing member, wherein the roller rotatably retains on the cam surface of the block member.

* * * * *